US005901465A

United States Patent [19]

Boussetta et al.

[11] Patent Number: 5,901,465

[45] Date of Patent: May 11, 1999

[54] CLOTHES DRYER WITH NOISE REDUCED DRUM

[75] Inventors: Iskander Boussetta; Sergio Giacobbe, both of Montreal, Canada

[73] Assignee: Camco Inc., Mississauga, Canada

[21] Appl. No.: 08/927,290

[22] Filed: Sep. 11, 1997

[30] Foreign Application Priority Data

Jun. 20, 1997 [CA] Canada ..... 2208388

[51] Int. Cl.[6] ..... F26B 11/02

[52] U.S. Cl. ..... 34/602; 34/242

[58] Field of Search ..... 34/601, 602, 603, 34/242

[56] References Cited

U.S. PATENT DOCUMENTS

| | | | |
|---|---|---|---|
| 5,127,169 | 7/1992 | Elligson | 34/602 |
| 5,216,823 | 6/1993 | Ripley | 34/601 |
| 5,363,569 | 11/1994 | Kadakia | 34/601 |
| 5,528,838 | 6/1996 | Timm et al. | 34/124 |
| 5,548,908 | 8/1996 | Torborg et al. | 34/601 |

FOREIGN PATENT DOCUMENTS

| | | |
|---|---|---|
| 2023999 | 1/1990 | Japan . |
| 7080193 | 3/1995 | Japan . |
| 7275582 | 10/1995 | Japan . |
| 8000898 | 1/1996 | Japan . |

*Primary Examiner*—Henry Bennett
*Assistant Examiner*—Pamela A. Wilson

[57] ABSTRACT

A clothes dryer is disclosed having improved noise insulation characteristics which requires minimum alteration of existing dryer drum construction thereby adding relatively little additional cost over and above the cost of materials. The clothes dryer has a rotating dryer drum with steel bands or straps fastened about the periphery of outside surface cylindrical wall of the dryer drum to absorb noise created by articles tumbling within the dryer drum during operation. An adhesive material is laminated to the band which secures the band to the outside wall of the dryer drum. Baffle mounting screws passing through the dryer drum are used to secure ends and intermediate parts of the band to the dryer drum.

26 Claims, 3 Drawing Sheets

CLOTHES DRYER WITH NOISE REDUCED DRUM

TECHNICAL FIELD OF THE INVENTION

The present invention relates to a clothes dryer having improved noise insulation characteristics. In particular the present invention relates to the use of one or more bands surrounding the outside surface of the dryer drum to improve noise insulation characteristics.

BACKGROUND OF THE INVENTION

Domestic clothes drying machines typically comprise a rotating steel dryer drum in which clothes are tumbled as warm air is circulated through the dryer drum drying the clothes. As the articles of clothing tumble within the dryer drum, the articles fall into contact with the drum wall. Heavier articles, metal buttons and loose coins have a tendency to impact the dryer drum and create noise. There is a need to reduce the noise created by clothes and other articles tumbling within the dryer drum.

To compensate or reduce the noise created by articles tumbling in the dryer drum, the use of a plastic drum has been suggested by Japanese patent application 7,080,193 published Mar. 28, 1995 to Sanyo Electric. Also Japanese patent applications 7,275,582 published Oct. 24, 1995 in the name of Nippon Kentetsu Co. and Japanese patent application 8,000,898 published Jan. 9, 1996 in the name of Hitachi Ltd. both teach the use of a plastic or foam sheet of plastic attached to be inside peripheral wall of the dryer drum to reduce noise. The problem with these dryers is that the plastic chosen will be subjected to high temperatures during drying and may be difficult to assemble inside the drum thereby significantly increasing the cost the dryer to the consumer.

In another attempt to reduce noise created by articles tumbling within a clothes dryer, Japanese patent application 2,023,999 published Jan. 28, 1990 teaches the use of a rotary dryer drum comprising a multi-layer metal plate with a plastic resin material positioned between the metallic plates. While this solution does not involve the use of a plastic sheet positioned in the inside of the dryer drum wall, the use of a laminated dryer drum comprising two steel plates having to be secured together with a resin material between the dryer drums, would be a difficult drum structure to manufacture increasing cost in the clothes dryer consumer.

Accordingly, there is a need for a clothes dryer having improved noise insulation characteristics which requires minimum alteration of existing dryer drum construction thereby adding relatively little additional cost to the clothes dryer.

SUMMARY OF THE INVENTION

The present invention is directed towards the use of steel bands or straps which may be readily fastened about the outside periphery of the cylindrical wall of the dryer drum to absorb noise created by articles tumbling within the dryer drum during operation. The invention utilizes an adhesive material laminated to the strap or band which sticks the band to the outside wall of the dryer drum by applying pressure. The present invention further utilizes baffle mounting screws passing through the dryer drum to secure ends and intermediate parts of the band to the dryer drum. The present invention has the advantage that it is relatively easy to assemble and the band effectively dampens of articles impacting the dryer drum wall.

In accordance with an aspect of the present invention there is provided a clothes dryer comprising a cabinet having a front wall with a clothes access opening therein and a door mounted to the cabinet to close the front access opening. The clothes dryer includes a rotatable drum mounted within the cabinet and adapted to receive articles of clothing to be dried through the front access opening. The drum has a substantially cylindrical shaped side wall. The side wall has an inside surface and an outside surface. The clothes dryer includes at least one band secured in contacting and surrounding relation to the outside surface of the cylindrical shaped side wall of the drum for dampening noise produced by the articles tumbling inside the drum during dryer operation.

The clothes dryer may further include an adhesive material placed between the outside surface of the drum and the band to secure the band to the drum and prevent slippage of the band about the drum. The adhesive material preferably comprises a layer of pressure sensitive adhesive material laminated to the band which secures the band to the outside surface of the drum when placed in contact with the outside surface of the drum. The adhesive material laminated to the band is covered with a protective wrap which is peeled off prior to assembly of the band to the outside surface of the dryer drum.

The band is preferably a strap having two ends that are secured in overlapping fashion to form the band. Preferably a fastening means comprising one screw passing through aligned apertures in the ends of the band and the drum to fasten the band to the drum. Preferably additional fastening means passing through the drum are spaced about the periphery of the drum to provide for additional positive securement of the band to the drum. The band is preferably a galvanized steel plate or strap and preferably covers at least ⅔ of outside surface of the cylindrical side wall of the dryer drum.

BRIEF DESCRIPTION OF THE DRAWINGS

A more complete understanding of the nature of the present invention may be obtained by reference to the following detailed description when taken in conjunction with the accompanying diagrammatic drawings wherein.

DETAILED DESCRIPTION OF EMBODIMENTS

Figure 1:
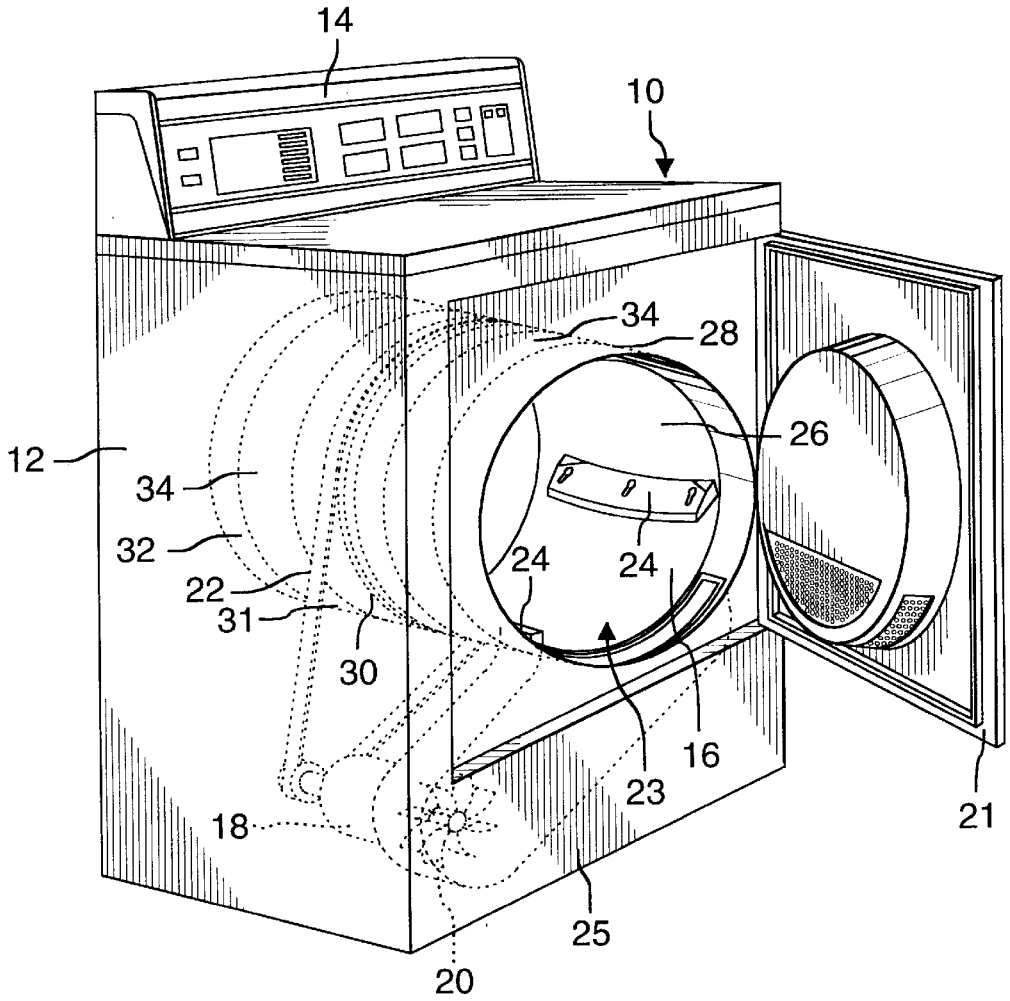
FIG. 1 is a perspective view of a clothes dryer of the present invention including the noise damping band.

Referring to FIG. 1 a domestic clothes dryer 10 is illustrated to show some of the basic details of the construction. The dryer may be heated by gas or electricity for the purpose of this invention, no difference in the application of this invention to the dryer will be experienced for dryers heated by either of the above methods. Dryer 10 is supplied with a suitable cabinet or housing 12 for mounting the control panel 14, rotating drum 16, motor 18 and blower 20. The cabinet 12 has front wall 25 supplied with a door 21 to give the user access to the drum 16 through access opening 23. Drum 16 is mounted in the cabinet 12 for rotation about its central axis and motor 18 is arranged to drive the drum by means of belt 22. The drum is also located in an air path so that the dry heated air is forced through the drum to extract moisture from the tumbling clothes therein.

The drum is provided with a set of baffles, one of which is shown at 24 in FIG. 1. The baffle is a substantially hollow molded plastic device which may be made of vinyl, or polypropylene, NORYL, trademark of General Electric Company, or some other high impact plastic material which will not lose its strength at drying temperatures and which has a resilient nature. The baffle is slightly curved so as to encourage the clothes to tumble toward the center of the drum 16 during a drying operation. The baffle 24 is mounted by bolts or screws to the inside surface 26 of the cylindrical drum sidewall 28 as described hereafter.

In order to provide clearance within cabinet 12 or the drive belt 22, suitable struts or webs 30 are formed at about the mid-point of the length of the cylindrical sidewall 28 of drum 16. These struts are shown on the outside surface 32 of the cylindrical sidewall 28 of the drum and define a belt receiving groove 31.

In accordance with the present invention a band or strap 34 surrounds the outside surface 32 of the cylindrical side wall 28 of drum 16 to dampen noise associate with articles impacting the inside surface 26 of the drum 16. Because the cylindrical side wall 32 of drum 16 is divided into two wall portions by the webs 30, two bands 34 are employed.

Figure 2:
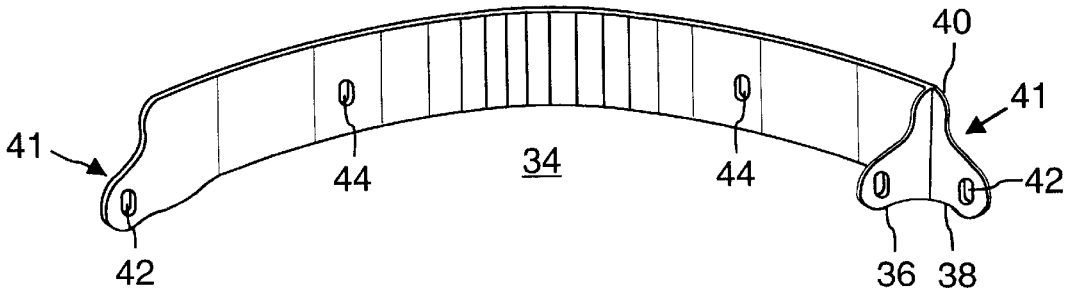
FIG. 2 is a perspective view of the band or strap of the present invention.

Referring to FIGS. 2, 3, 4 and 5 of the drawings the preferred embodiment for the bands 34 is described. The construction of the band 34 is best seen in FIG. 2. The band 34 comprises an elongated strip of metal 40 having a pressure sensitive adhesive material 38 laminated on one side thereof. A paper backing 36 overlies the adhesive 38 and is peeled from the adhesive 38 during assembly of the band 34 to outside surface 32 of drum 16. The metal 40 of band 30 is a galvanized steel having a thickness of about 0.015 inches. The ends 41 of the band 34 include apertures 42 and intermediate apertures 44. These apertures are used to positively secure the strap to the outside shell 32 of the drum 16.

Figure 3:
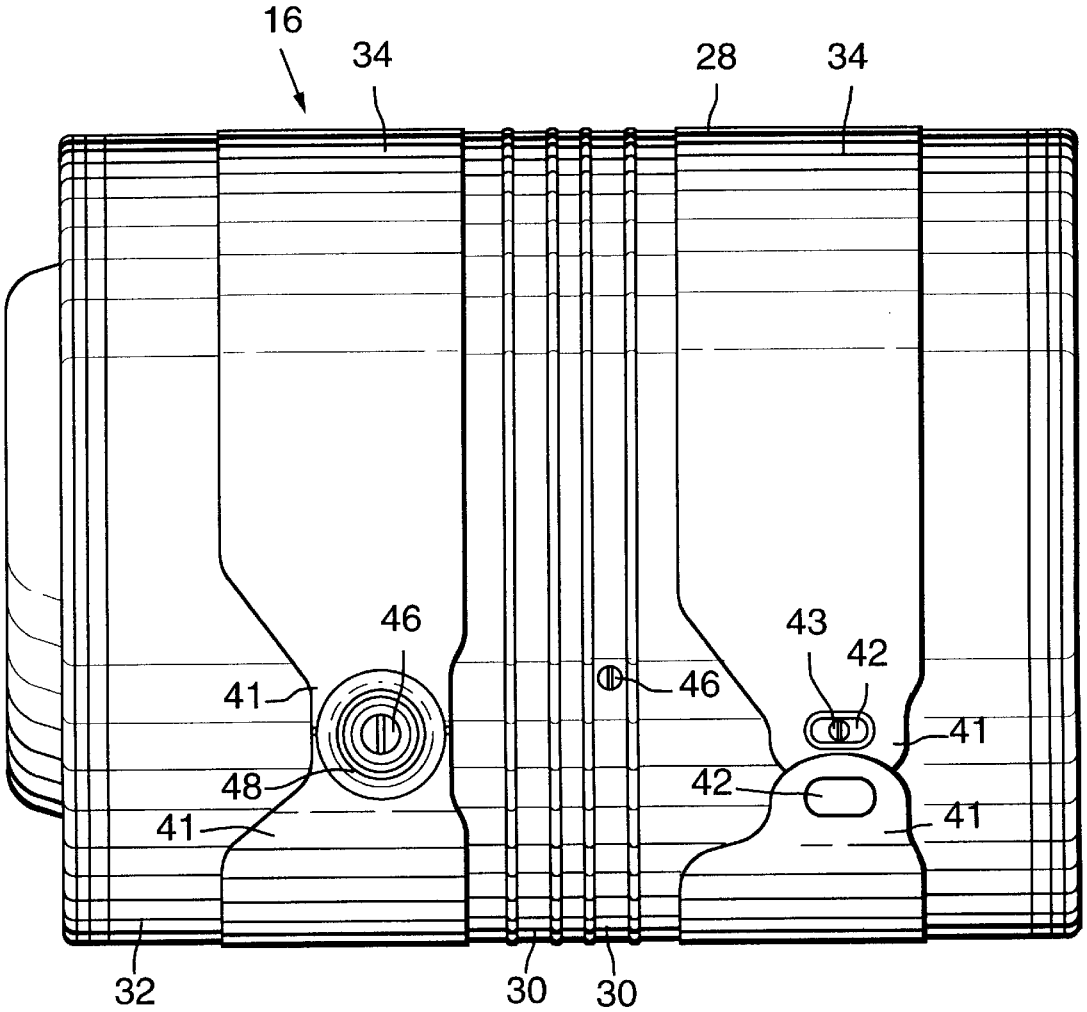
FIG. 3 is a view of the dryer drum of the present invention showing the bands surrounding the dryer drum.
Figure 4:
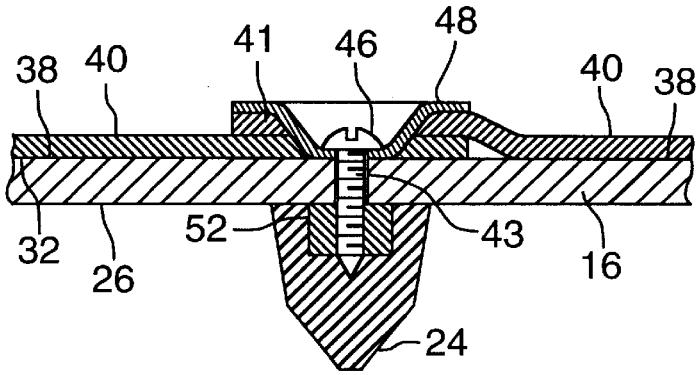
FIG. 4 is a cross sectional view showing the end connection of the band to the dryer drum.
Figure 5:
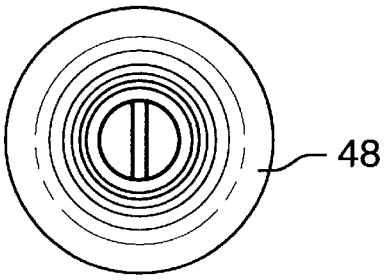
FIG. 5 is a plan view of the washer bracket used to secure the ends of the bands in FIG. 4; and, FIG. 6 is a sectional view similar to FIG. 4 showing an alternative embodiment for securing the ends of the bands.

In FIGS. 3 and 4, the assembly of the noise damping panels or bands 34 is shown. For assembly, the paper 36 is peeled from the adhesive layer 38 of the band 34 and the band 34 is placed around the outside surface 32 of the cylindrical wall 28 of drum 16. The ends 41 are placed with their apertures 42 aligned over aperture 43 in drum 16. This is shown in FIG. 3 where the right most band 34 has its ends 41 shown in the process of being overlapped. The left most band 34 is shown assembled to the outside surface 32 of drum 16. For the left most band 34, the apertures 42 of the band 34 are aligned over the aperture 43 of drum 16 and securing screw 46 cooperates with washer bracket 48 to hold the ends 41 of the band 34 in place. A plan view of washer 48 is shown in FIG. 5.

In FIG. 4, the screw 46 passes also through cylinder retaining mount 52 of baffle 24. The screw 46 is held by its threads in cylinder 52 and as the screw 46 is tightened screw 46 draws washer 48 down and deforms washer 48 against the ends 41 of the band 34. In FIG. 3, the screws 46 and aperture 43 represent the three mounting screws used to hold baffle 24 to the inside surface 26 of drum 16. Because three baffles are evenly spaced about the inside wall of the drum, additional mounting screws 46 and washer brackets 48 can be used in a manner similar to that shown in FIG. 4 by passing through the intermediate apertures 44 in band 34.

Figure 6:
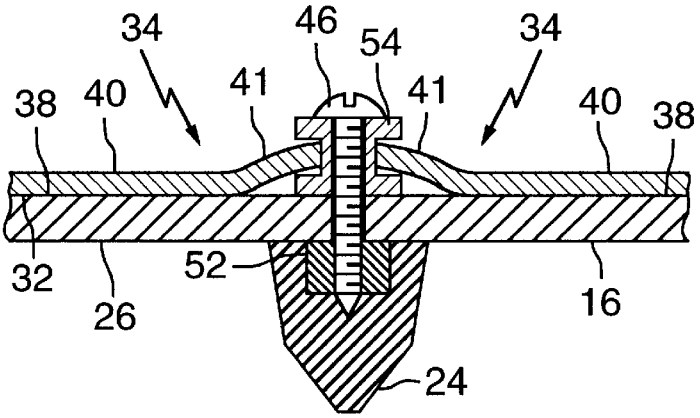

Referring to FIG. 6, an alternative embodiment for the fastening means used in the present invention to hold the ends of the bands 34 in place against the drum 16 includes a bracket 54 having two U shaped receiving grooves into which the ends 41 of the band 34 are inserted and secured in a manner similar to that described for FIG. 4.

What is claimed is:

1. A clothes dryer comprising:

a cabinet having a front wall with a clothes access opening therein and a door mounted to the cabinet to close the clothes access opening;

a rotatable drum mounted within the cabinet and adapted to receive articles of clothing to be dried through said clothes access opening, said drum having a substantially cylindrical shaped side wall, and said side wall having an inside surface and an outside surface; and, at least one band secured in fixed surrounding contact to the outside surface of the cylindrical shaped side wall of said drum for dampening noise produced by the articles tumbling inside said drum during dryer operation.

2. The clothes dryer of claim 1 further including an adhesive material placed between the outside surface of the drum and the band to secure the band to the drum and prevent slippage of the band about the drum.

3. The clothes dryer of claim 2 wherein the adhesive material comprises a layer of pressure sensitive adhesive material laminated to the band which secures the band to the outside surface of the drum when placed in contact with the outside surface of the drum.

4. The clothes dryer of claim 3 wherein the adhesive material laminated to the band is covered with a protective wrap which is peeled off prior to assembly of the band to the outside surface of the dryer drum.

5. The clothes dryer of claim 2 wherein the band has two ends that are adjacent to each other and the dryer further including a bracket mounted to the drum between the two adjacent ends of the band, the bracket including two receiving grooves each respectively receiving one of the two adjacent ends of said band to secure the ends of said band in place relative to said drum.

6. The clothes dryer of claim 2 wherein the band has two ends and the clothes dryer further including fastening means for the two ends of the band to the drum, said fastening means including at least one screw passing through aligned apertures in the ends of the band and the drum to fasten the band to the drum.

7. The clothes dryer of claim 6 wherein the two ends of the band overlap and one screw passes through aligned apertures of the two bands aligned with an aperture passing through the drum.

8. The clothes dryer of claim 7 wherein a deformable washer bracket is held in place by the one screw against one of the band ends.

9. The clothes dryer of claim 6 further including at least one baffle mounted to the inside surface of said drum, said baffle being at least partially fastened to said drum by said at least one screw.

10. The clothes dryer of claim 9 further including additional fastening screws passing through the drum spaced about the periphery of the drum to provide for additional positive securement of the band to the drum.

11. The clothes dryer of claim 1 wherein the band is a steel plate.

12. The clothes dryer of claim 1 wherein the band overlays at least ⅔ of outside surface of the cylindrical side wall of the dryer.

13. The clothes dryer of claim 1 wherein the band has edges that are spaced inwardly from ends of the cylindrical side wall.

14. A clothes dryer comprising:

a cabinet having a front wall with a clothes access opening therein and a door mounted to the cabinet to close the clothes access opening;

a rotatable drum mounted within the cabinet and adapted to receive articles of clothing to be dried through said clothes access opening, said drum having a substantially cylindrical shaped side wall, and said side wall having an inside surface and an outside surface, said drum including a reinforcing strut surrounding the outside surface of the drum and defining at least one belt drive receiving groove and dividing the outside surface of the drum into two halves; a drive belt and a motor for driving said drive belt around the belt drive receiving groove of said drum; and, two bands secured in contacting and surrounding relation to a respective half of the outside surface of the cylindrical shaped side wall of said drum for absorbing noise produced by the articles tumbling inside said drum during dryer operation.

15. The clothes dryer of claim 14 further including an adhesive material placed between the outside surface of the drum and each of the bands to secure the bands to the drum and prevent slippage of the bands about the drum.

16. The clothes dryer of claim 14 wherein the adhesive material comprises a layer of pressure sensitive adhesive material laminated to each of the bands which secures the bands to the outside surface of the drum when placed in contact with the outside surface of the drum.

17. The clothes dryer of claim 16 wherein the adhesive material laminated to the bands is covered with a protective wrap which is peeled off prior to assembly of the bands to the outside surface of the dryer drum.

18. The clothes dryer of claim 15 wherein each of the bands has two ends that are adjacent to each other and the dryer further including a bracket mounted to the drum between the two adjacent ends of the band, the bracket including two receiving grooves each respectively receiving one of the two adjacent ends of said band to secure the ends of said band in place relative to said drum.

19. The clothes dryer of claim 15 wherein each of the bands has two ends and the clothes dryer further including fastening means for the two ends of the band to the drum, said fastening means including at least one screw passing through aligned apertures in the ends of the band and the drum to fasten the band to the drum.

20. The clothes dryer of claim 19 wherein the two ends of each of the bands overlap and one screw passes through aligned apertures of the two bands aligned with an aperture passing through the drum.

21. The clothes dryer of claim 20 wherein a deformable washer bracket is held in place by the one screw against one of the band ends.

22. The clothes dryer of claim 19 further including at least one baffle mounted to the inside surface of said drum, said baffle being at least partially fastened to said drum by said at least one screw.

23. The clothes dryer of claim 22 further including additional fastening screws passing through the drum spaced about the periphery of the drum to provide for additional positive securement of the band to the drum.

24. The clothes dryer of claim 14 wherein the band is a steel plate.

25. The clothes dryer of claim 14 wherein the band overlays at least ⅔ of outside surface of the cylindrical side wall of the dryer.

26. The clothes dryer of claim 14 wherein the band has edges that are spaced inwardly from ends of the cylindrical side wall.

* * * * *